US009095024B1

(12) United States Patent
Zhang et al.

(10) Patent No.: US 9,095,024 B1
(45) Date of Patent: Jul. 28, 2015

(54) BACKLIGHT DRIVING CIRCUIT AND METHOD FOR REDUCING SOFT-START TIME THEREOF

(71) Applicant: Shenzhen China Star Optoelectronics Technology Co., Ltd., Guangdong (CN)

(72) Inventors: Hua Zhang, Shenzhen (CN); Fei Li, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 13/985,891

(22) PCT Filed: Jul. 8, 2013

(86) PCT No.: PCT/CN2013/079021

§ 371 (c)(1),
(2) Date: Aug. 16, 2013

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/0815* (2013.01)

(58) Field of Classification Search
None
See application file for complete search history.

(56) References Cited

U.S. PATENT DOCUMENTS

| | | | | |
|---|---|---|---|---|
| 7,531,971 | B2 * | 5/2009 | Weng | 315/291 |
| 7,550,934 | B1 * | 6/2009 | Deng et al. | 315/308 |

* cited by examiner

*Primary Examiner* — Douglas W Owens
*Assistant Examiner* — Dedei K Hammond
(74) *Attorney, Agent, or Firm* — Andrew C. Cheng

(57) ABSTRACT

The present invention provides a backlight driving circuit and a method for reducing the soft-start time of the backlight driving circuit. The backlight driving circuit comprises a constant current driving chip 22, a first circuit part 24 which is electrically connected to the constant current driving chip 22, and a second circuit part 26 which is electrically connected to the constant current driving chip 22. In the backlight driving circuit and the method for reducing the soft-start time of the backlight driving circuit according to the present invention, it controls the driving signal frequency of the constant current driving chip to set the resistance value by adding a voltage detection circuit on the soft-start pin, and further changes the frequency of the driving signal of the first thin film transistor. During the soft-start time, it increases the charging speed of the second capacitor, reducing the boot soft-start time, decreasing the current flowing through the inductor and the first thin film transistor during boot time, and increasing the life time.

11 Claims, 3 Drawing Sheets

BACKLIGHT DRIVING CIRCUIT AND METHOD FOR REDUCING SOFT-START TIME THEREOF

BACKGROUND OF THE INVENTION

1. Field of the Invention

The present invention relates to the display technical field, and in particular to a backlight driving circuit and a method for reducing the soft-start time thereof.

2. The Related Arts

Liquid crystal display (LCD) has a thin body, energy saving, no radiation and many other advantages to achieve the wide application. Most of the liquid crystal displays in the existing market are backlight-type liquid crystal display, which comprise liquid crystal panel and backlight module. The working principle of the liquid crystal panel is to place liquid crystal molecules in the two parallel glass substrates, there are plurality of vertical and horizontal fine wires between the two glass substrates, to control the rotation of the liquid crystal molecules through applying the driving voltage to the two parallel glass substrates, to generate the screen by refracting the light of the backlight module. Since the LCD panel does not light by itself, it requires borrowing a light source provided by the backlight module to display properly. Therefore, backlight module becomes one of the key components of the LCD device. The backlight module is divided to edge type backlight module and direct type backlight module according to the different location of the incident light. The direct type backlight module is to set the light source such as cold cathode fluorescent lamp (CCFL) or light emitting diode (LED) to the back of the liquid crystal panel, and directly forming the surface light source which is provided to the liquid crystal panel. The edge type backlight module is to set the backlight source LED light bar to the back edge behind the liquid crystal panel, the light emitted from the LED light bar enters into the light guide plate (LGP) from the surface of the incident light on the one side of the LGP, and emits from the light exit surface of the LGP after reflected and diffused, forming the surface light source which is provided to the liquid crystal panel through the optical film group.

Referring to FIG. 1, which is the LED backlight driving circuit according to the prior art, wherein, the constant current driving chip 100 has an internal soft-start function. When the driving power source 200 inputs the driving voltage to the circuit, the duty of the driving signal output by the constant current driving chip 100 to drive the thin film transistor Q100 will slowly open. At the same time, it charges the capacitor C200 on the soft-start, SS, pin 3. When the voltage on the third pin of the SS pin3 reaches a certain value, the constant current driving chip 100 starts to work properly. The function of the soft-start is mainly to prevent that the feedback output voltage of the constant current driving chip 100 is too low when the circuit just boots, which makes the driving signal duty of the thin film transistor Q100 too high, resulting the current through the inductor L100 and the thin film transistor Q100 of the circuit being too high, and damaging the components.

When the constant current driving chip 100 soft-starts, the driving frequency of the driving signal output to the thin film transistor Q100 and that in normal operation are the same. In order to prevent that the switching loss on the thin film transistor Q100 is too high and affects its normal operating temperature, the driving frequency is set lower. Therefore, each cycle time is longer, resulting the soft-start time being longer, and affecting the boot speed of the display device, such as television, etc.

SUMMARY OF THE INVENTION

The purpose in the present invention is to provide a backlight driving circuit, which adds the voltage detection circuit of the soft-start pin, thereby controlling the driving signal frequency in the circuit to set the resistance value, reducing the boot soft-start time, and decreasing the current through the inductor and the first thin film transistor.

The other purpose in the present invention is to provide a method for reducing the soft-start time of the backlight driving circuit, changing the driving signal frequency by changing the driving signal frequency of the constant current driving chip to set the resistance value, increasing the charging speed of the second capacitor, reducing the boot soft-start time, decreasing the current through the inductor and the first thin film transistor.

In order to achieve the above propose, the present invention provides a backlight driving circuit, comprising: a constant current driving chip, a first circuit part which is electrically connected to the constant current driving chip, and a second circuit part which is electrically connected to the constant current driving chip;

wherein, the constant current driving chip comprises a first pin, a second pin, a third pin and a fourth pin, the first circuit part is electrically connected to the constant current driving chip through the first pin and the fourth pin, the second circuit part is electrically connected to the constant current driving chip through the second pin and the third pin;

wherein, the first circuit part comprises an inductor L, a first thin film transistor Q1, a diode D1, a first capacitor C1 and a first resistor R1, one end of the inductor L is used to electrically connect to a driving power, the other end is electrically connected to the first thin film transistor Q1 and the anode of diode D1, the first thin film transistor Q1 is electrically connected to the first pin, the first thin film transistor Q1 is further connected to the ground, the cathode of diode D1 is electrically connected to a LED string, one end of the capacitor C1 is electrically connected to the cathode of the diode D1, and the other end is connected to the ground, one end of the first resistor R1 is connected to the ground, and the other end is electrically connected to the fourth pin and the LED string;

wherein, the second circuit part comprises a first voltage comparator D2, a second thin film transistor Q2, a second resistor R2, a third resistor R3 and a second capacitor C2, the first voltage comparator D2 comprises a first positive input terminal, a first negative input terminal and a first output terminal, the first positive input terminal of the first voltage comparator D2 is electrically connected to a first voltage source, the first negative input terminal is electrically connected to the third pin and one end of the second capacitor C2, the first output terminal is electrically connected to the second thin film transistor Q2, the second thin film transistor Q2 is electrically connected to the one end of the second resistor R2, the second thin film transistor Q2 is also connected to the ground, the other end of the second resistor R2 is electrically connected to the second pin, one end of the third resistor R3 is electrically connected to the other end of the second resistor R2, and the other end is connected to the ground, the other end of the second capacitor C2 is connected to the ground; the output voltage of the first voltage source is lower than the predetermined voltage value of the second capacitor C2.

The first thin film transistor Q1 comprises a first gate g1, a first source s1 and a first drain d1, the first gate g1 is electrically connected to the first pin, the first source s1 is electrically connected to the ground, the first drain d1 is respectively connected to the anode of the diode D1 and the other end of the first inductor L.

The second thin film Q2 comprises a second gate g2, a second source s2 and a second drain d2, the second gate g2 is electrically connected to the first output terminal of the first voltage comparator D2, the second source s2 is electrically connected to the ground, the second drain d2 is electrically connected to the other end of the second resistor R2.

The constant current driving chip comprises: a control module, a second voltage comparator D3, a current source and a second voltage source, the control module comprises a fifth to an eighth pin, the second voltage comparator D3 comprises a second positive input pin, a second negative input pin and a second output pin, the fifth pin is respectively connected to the first pin and the third pin, the sixth pin is electrically connected to the second pin, the seventh pin is electrically connected to the second output terminal of the second comparator D3, the eighth pin is electrically connected to the fourth pin, the second positive input pin is respectively connected to the current source, the third pin, the fifth pin and the first pin, the second negative input pin is electrically connected to the second voltage source.

The present invention also provides a backlight driving circuit, comprising: a constant current driving chip, a first circuit part which is electrically connected to the constant current driving chip, and a second circuit part which is electrically connected to the constant current driving chip;

wherein, the constant current driving chip comprises a first pin, a second pin, a third pin and a fourth pin, the first circuit part is electrically connected to the constant current driving chip through the first pin and the fourth pin, the second circuit part is electrically connected to the constant current driving chip through the second pin and the third pin;

wherein, the first circuit part comprises an inductor L, a first thin film transistor Q1, a diode D1, a first capacitor C1 and a first resistor R1, one end of the inductor L is used to electrically connect to a driving power, the other end is electrically connected to the first thin film transistor Q1 and the anode of diode D1, the first thin film transistor Q1 is electrically connected to the first pin, the first thin film transistor Q1 is further connected to the ground, the cathode of diode D1 is electrically connected to a LED string, one end of the capacitor C1 is electrically connected to the cathode of the diode D1, and the other end is connected to the ground, one end of the first resistor R1 is connected to the ground, and the other end is electrically connected to the fourth pin and the LED string;

wherein, the second circuit part comprises a first voltage comparator D2, a second thin film transistor Q2, a second resistor R2, a third resistor R3 and a second capacitor C2, the first voltage comparator D2 comprises a first positive input terminal, a first negative input terminal and a first output terminal, the first positive input terminal of the first voltage comparator D2 is electrically connected to a first voltage source, the first negative input terminal is electrically connected to the third pin and one end of the second capacitor C2, the first output terminal is electrically connected to the second thin film transistor Q2, the second thin film transistor Q2 is electrically connected to the one end of the second resistor R2, the second thin film transistor Q2 is also connected to the ground, the other end of the second resistor R2 is electrically connected to the second pin, one end of the third resistor R3 is electrically connected to the other end of the second resistor R2, and the other end is connected to the ground, the other end of the second capacitor C2 is connected to the ground; the output voltage of the first voltage source is lower than the predetermined voltage value of the second capacitor C2;

wherein, the first thin film transistor Q1 comprises a first gate g1, a first source s1 and a first drain d1, the first gate g1 is electrically connected to the first pin, the first source s1 is electrically connected to the ground, the first drain d1 is respectively connected to the anode of the diode D1 and the other end of the first inductor L;

wherein, the second thin film Q2 comprises a second gate g2, a second source s2 and a second drain d2, the second gate g2 is electrically connected to the first output terminal of the first voltage comparator D2, the second source s2 is electrically connected to the ground, the second drain d2 is electrically connected to the other end of the second resistor R2.

The constant current driving chip comprises: a control module, a second voltage comparator D3, a current source and a second voltage source, the control module comprises a fifth to an eighth pin, the second voltage comparator D3 comprises a second positive input pin, a second negative input pin and a second output pin, the fifth pin is respectively connected to the first pin and the third pin, the sixth pin is electrically connected to the second pin, the seventh pin is electrically connected to the second output terminal of the second comparator D3, the eighth pin is electrically connected to the fourth pin, the second positive input pin is respectively connected to the current source, the third pin, the fifth pin and the first pin, the second negative input pin is electrically connected to the second voltage source.

The present invention also provides a method for reducing soft-start time of the backlight driving circuit, comprising the following steps:

step 10, providing a backlight driving circuit, which comprises: a constant current driving chip, a first circuit part which is electrically connected to the constant current driving chip, and a second circuit part which is electrically connected to the constant current driving chip; wherein, the first circuit part comprises an inductor L, a first thin film transistor Q1, a diode D1, a first capacitor C1 and a first resistor R1, one end of the inductor L is used to electrically connect to a driving power, the other end is electrically connected to the first thin film transistor Q1 and the anode of diode D1, the first thin film transistor Q1 is electrically connected to a first pin, the first thin film transistor Q1 is also connected to the ground, the cathode of diode D1 is electrically connected to a LED string, one end of the capacitor C1 is electrically connected to the cathode of the diode D1, and the other end is connected to the ground, one end of the first resistor R1 is connected to the ground, and the other end is electrically connected to a fourth pin and the LED string; wherein, the second circuit part comprises a first voltage comparator D2, a second thin film transistor Q2, a second resistor R2, a third resistor R3 and a second capacitor C2, the first voltage comparator D2 comprises a first positive input terminal, a first negative input terminal and a first output terminal, the first positive input terminal of the first voltage comparator D2 is electrically connected to a first voltage source, the first negative input terminal is electrically connected to a third pin and one end of the second capacitor C2, the first output terminal is electrically connected to the second thin film transistor Q2, the second thin film transistor Q2 is electrically connected to the one end of the second resistor R2, the second thin film transistor Q2 is further connected to the ground, the other end of the second resistor R2 is electrically connected to a second pin, one end of the third resistor R3 is electrically connected to the other end of the second resistor R2, the other end is connected to the ground, and the other end of the second capacitor C2 is connected to the ground; the output voltage of the first voltage source is lower than the predetermined voltage value of the second capacitor C2;

step 20, during boot time, the third pin charging the second capacitor C2, thus the voltage of the third pin being lower, the voltage of the first positive input terminal of the first voltage comparator D2 being higher than the voltage of the first negative input terminal, the first voltage comparator D2 outputting a high voltage to the second thin film transistor Q2;

step 30, the second thin film transistor Q2 turning on, the first resistor R1 and the second resistor R2 being connected in parallel, the total resistance on the second pin being decreased, the frequency of the driving signal output transferred to the first thin film transistor Q1 by the constant current driving chip being decreased, the turning-on time per cycle of the first thin film transistor Q1 being decreased, at the same time, the frequency of the constant current driving chip charging to the second capacitor C2 being decreased, improving the charging speed;

step 40, as the charge of the second capacitor C2, when the voltage of the first negative input terminal of the first voltage comparator D2 being higher than that of the first positive input terminal, which means the voltage of the second capacitor is raised to the predetermined voltage value, the first voltage comparator D2 outputting the low voltage;

step 50, the second thin film transistor Q2 is turned off, disconnecting the second resistor R2, the driving frequency of the driving signal output to the first thin film transistor Q1 by the constant current driving chip being decreased, returning to the normal state, the constant current driving chip being into normal operation state.

The first thin film transistor Q1 comprises a first gate g1, a first source s1 and a first drain d1, the first gate g1 is electrically connected to the first pin, the first source s1 is electrically connected to the ground, and the first drain d1 is respectively connected to the anode of the diode D1 and the other end of the first inductor L.

When the voltage on the first gate g1 of the first thin film transistor Q1 is high voltage, the constant current driving chip 22 charges the second capacitor C2; when the voltage on the first gate g1 is low voltage, the constant current driving chip stops charging the second capacitor C2.

The second thin film Q2 comprises a second gate g2, a second source s2 and a second drain d2, the second gate g2 is electrically connected to the first output terminal of the first voltage comparator D2, the second source s2 is electrically connected to the ground, the second drain d2 is electrically connected to the other end of the second resistor R2.

The constant current driving chip comprises: a control module, a second voltage comparator D3, a current source and a second voltage source, the control module comprises a fifth to an eighth pin, the second voltage comparator D3 comprises a second positive input pin, a second negative input pin and a second output pin, the fifth pin is respectively connected to the first pin and the third pin, the sixth pin is electrically connected to the second pin, the seventh pin is electrically connected to the second output terminal of the second comparator D3, the eighth pin is electrically connected to the fourth pin, the second positive input pin is respectively connected to the current source, the third pin, the fifth pin and the first pin, the second negative input pin is electrically connected to the second voltage source.

The benefits of the present invention are as follows. The backlight driving circuit and the method for reducing the soft-start time of the backlight driving circuit according to the present invention control the driving signal frequency of the constant current driving chip to set the resistance value by adding a voltage detection circuit on the soft-start pin, and further changes the frequency of the driving signal of the first thin film transistor. During the soft-start, it increases the charging speed of the second capacitor, reduces the boot soft-start time, decreases the current through the inductor and the first thin film transistor during the boot time, reduces the risk of inrush current during boot time, and extends the service life.

In order to more clearly describe the embodiments in the present invention or the technical solutions in the prior art, the detailed descriptions of the present invention and the accompanying drawings are as follows. However, the drawings and descriptions are only used as reference, which is not intended to limit the present invention.

BRIEF DESCRIPTION OF THE DRAWINGS

The detailed descriptions accompanying drawings and the embodiment of the present invention are as follows, which allows the technical solutions and other beneficial effects of the present invention more obvious.

DETAILED DESCRIPTION OF THE PREFERRED EMBODIMENTS

In order to more clearly describe the technical solutions and the effects in the present invention, the preferred embodiment of the present invention accompanying drawings are described in detail as follows.

Figure 1:
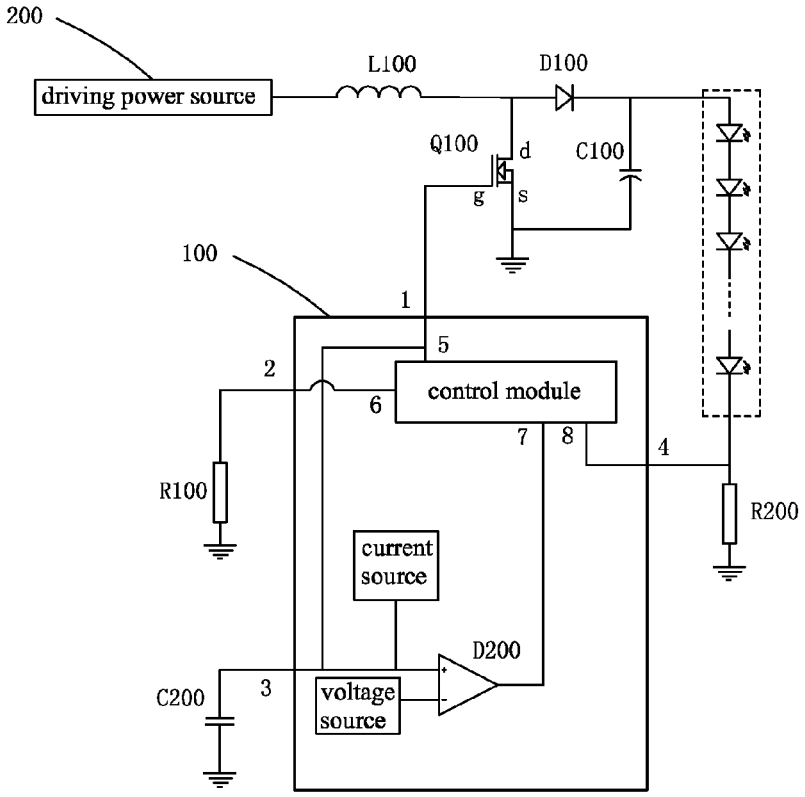
Fig. 1 (Prior Art)
FIG. 1 is a schematic diagram of the backlight driving circuit according to the prior art.
Figure 2:
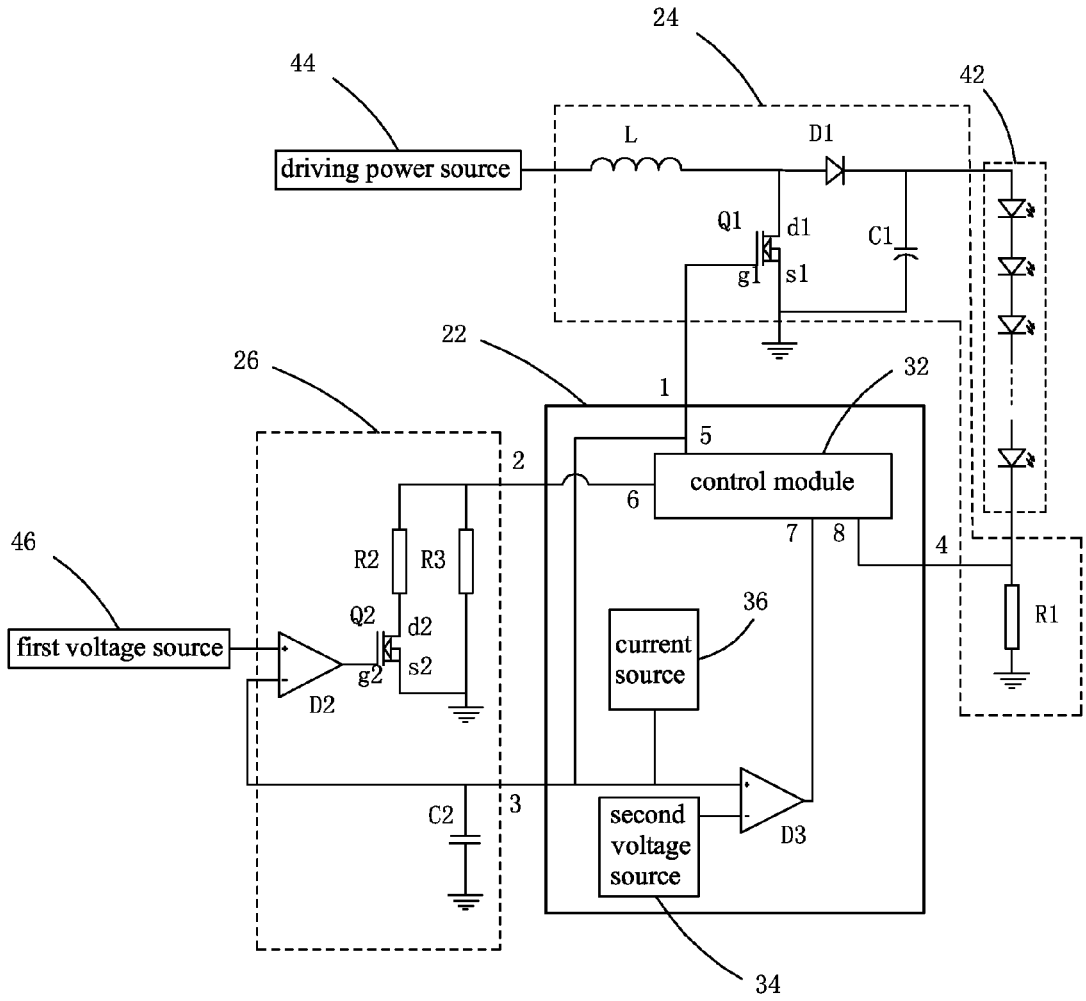
FIG. 2 is a schematic diagram of the backlight driving circuit according to the present invention.
Figure 3:
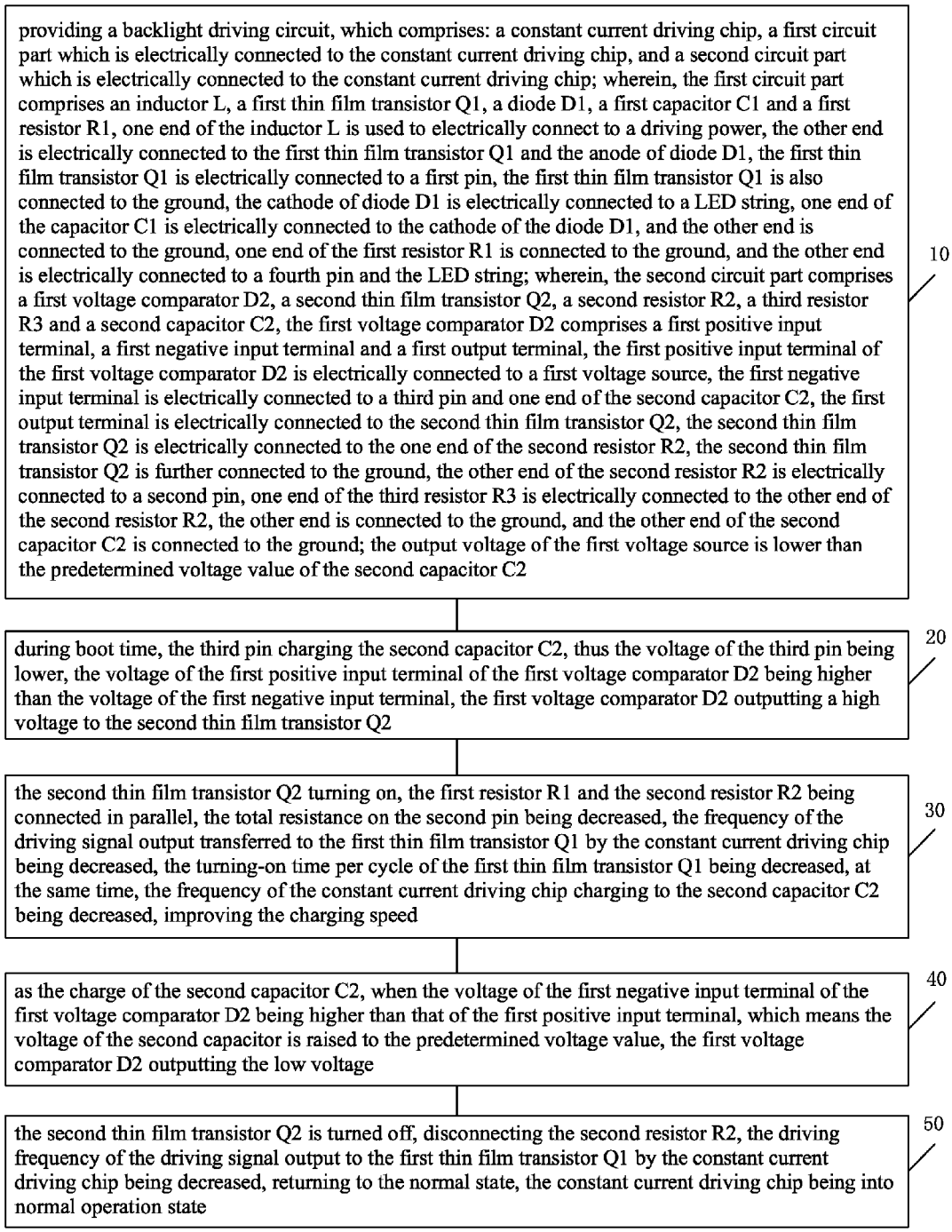
FIG. 3 is a flow chart of the method for reducing the soft-start time of the backlight driving circuit according to the present invention.

Please referring to FIG. 2, the present invention provides a backlight driving circuit, by providing the detection circuit to detect the voltage value on the soft-start pin (third pin 3) of the constant current driving chip 22, further changing the driving signal frequency in the circuit to set the resistance value, thereby changing the driving signal frequency of the first thin film transistor Q1, increasing the charging speed of the capacitor (second capacitor C2) on the soft-start pin, and decreasing the boot soft-start time.

Specifically, the backlight driving circuit comprises: a constant current driving chip 22, a first circuit part 24 which is electrically connected to the constant current driving chip 22, and a second circuit part 26 which is electrically connected to the constant current driving chip 22;

wherein, the constant current driving chip 22 comprises a first pin 1, a second pin 2, a third pin 3 and a fourth pin 4, the first circuit part 24 is electrically connected to the constant current driving chip 22 through the first pin 1 and the fourth pin 4, the second circuit part 26 is electrically connected to the constant current driving chip through the second pin 2 and the third pin 3.

The first circuit part 24 comprises an inductor L, a first thin film transistor Q1, a diode D1, a first capacitor C1 and a first resistor R1, one end of the inductor L is used to electrically connect to a driving power 44. The other end is electrically connected to the first thin film transistor Q1 and the anode of diode D1. The first thin film transistor Q1 is electrically connected to the first pin 1. The first thin film transistor Q1 is also connected to the ground. The cathode of diode D1 is electrically connected to a LED string 42. One end of the capacitor C1 is electrically connected to the cathode of the diode D1, and the other end is connected to the ground. One end of the first resistor R1 is connected to the ground, and the other end is electrically connected to the fourth pin 4 and the LED string 42.

The second circuit part 26 comprises a first voltage comparator D2, a second thin film transistor Q2, a second resistor R2, a third resistor R3 and a second capacitor C2. The first voltage comparator D2 comprises a first positive input terminal, a first negative input terminal and a first output terminal. The first positive input terminal of the first voltage comparator D2 is electrically connected to a first voltage source 46. The first negative input terminal is electrically connected to the third pin 3 and one end of the second capacitor C2. The first output terminal is electrically connected to the second thin film transistor Q2. The second thin film transistor Q2 is electrically connected to the one end of the second resistor R2, the second thin film transistor Q2 is further connected to the ground, and the other end of the second resistor R2 is electrically connected to the second pin 2. One end of the third resistor R3 is electrically connected to the other end of the second resistor R2, and the other end is connected to the ground. The other end of the second capacitor C2 is connected to the ground.

The output voltage of the first voltage source 46 is lower than the predetermined voltage value of the second capacitor C2, so it can change the output voltage of the first voltage comparator D2 by charging to the second capacitor C2. The predetermined voltage of the second capacitor C2 can be the voltage of the second capacitor C2 which is fully charged, the value thereof can be determined by choosing the specification of the second capacitor C2. The first capacitor C1 is polarized capacitor, the positive electrode thereof is electrically connected to the negative electrode of the diode D1, and the negative electrode thereof is connected to the ground.

The first thin film transistor Q1 comprises a first gate g1, a first source s1 and a first drain d1. Preferably, the first gate g1 is electrically connected to the first pin 1, the first source s1 is electrically connected to the ground, and the first drain d1 is respectively connected to the anode of the diode D1 and the other end of the first inductor L. When the voltage on the first gate g1 of the first thin film transistor Q1 is high voltage, the constant current driving chip 22 charges the second capacitor C2; when the voltage on the first gate g1 is low voltage, the constant current driving chip 22 stops charging the second capacitor C2. The second thin film Q2 comprises a second gate g2, a second source s2 and a second drain d2. Preferably, the second gate g2 is electrically connected to the first output terminal of the first voltage comparator D2, the second source s2 is electrically connected to the ground, and the second drain d2 is electrically connected to the other end of the second resistor R2.

Furthermore, the constant current driving chip 22 comprises: a control module 32, a second voltage comparator D3, a current source 36 and a second voltage source 34. The control module 32 comprises a fifth pin to an eighth pin 5, 6, 7, 8. The second voltage comparator D3 comprises a second positive input pin, a second negative input pin and a second output pin. The fifth pin 5 is respectively connected to the first pin 1 and the third pin 3. The sixth pin 6 is electrically connected to the second pin 2. The seventh pin 7 is electrically connected to the second output terminal of the second comparator D3. The eighth pin 8 is electrically connected to the fourth pin 4. The second positive input pin is respectively connected to the current source 36, the third pin 3, the fifth pin 5 and the first pin 1. The second negative input pin is electrically connected to the second voltage source 34. The current source 36 is used to charge to the second capacitor C2. The output voltage value of the second voltage source 34 is chosen according to the actual requirements. The control module 32 adjusts and drives the frequency of the signals of the thin film transistor Q1 according to the total resistance on the second pin 2.

Gather the voltage on the third pin 3 through the first voltage comparator D2, and further judge if the backlight driving circuit is in the soft-start stage. When the backlight driving circuit is in the soft-start stage, the first voltage comparator D2 outputs high voltage, so that the second thin film transistor Q2 is turned on, the second resistor R2 and the third resistor R3 are connected in parallel, further reducing the total resistance value (the driving signal frequency set resistance) on the second pin 2, thereby changing the frequency of the driving signal of the first thin film transistor Q1, increasing the charging speed of the capacitor (the second capacitor C2) on the soft-start pin, and decreasing the boot soft-start time. As the charge of the second capacitor C2, the first voltage comparator D2 outputs low voltage, and the second thin film transistor Q2 is turned off. There is only the third resistor R3 on the second pin 2, which means the driving signal frequency set resistance is increased. The frequency of the driving signal output to the first thin film transistor Q1 by the constant current driving chip 22 is decreased, which is recovered to normal state. The constant current driving chip 22 works in normal operation. At this point, the soft-start of the backlight driving circuit is completed.

The present invention also provides a method for reducing the soft-start time of the backlight driving circuit, which comprises the following steps:

step 10, providing a backlight driving circuit, which comprises: a constant current driving chip 22, a first circuit part 24 which is electrically connected to the constant current driving chip 22, and a second circuit part 26 which is electrically connected to the constant current driving chip 22; wherein, the constant current driving chip 22 comprises a first pin 1, a second pin 2, a third pin 3 and a fourth pin 4, the first circuit part 24 is electrically connected to the constant current driving chip 22 through the first pin 1 and the fourth pin 4, the second circuit part 26 is electrically connected to the constant current driving chip 22 through the second pin 2 and the third pin 3; the first circuit part 24 comprises an inductor L, a first thin film transistor Q1, a diode D1, a first capacitor C1 and a first resistor R1, one end of the inductor L is used to electrically connect to the driving power 44, the other end is electrically connected to the first thin film transistor Q1 and the anode of diode D1, the first thin film transistor Q1 is electrically connected to the first pin 1, the first thin film transistor Q1 is further connected to the ground, the cathode of diode D1 is electrically connected to the LED string 42, one end of the capacitor C1 is electrically connected to the cathode of the diode D1, and the other end is connected to the ground, one end of the first resistor R1 is connected to the ground, and the other end is electrically connected to the fourth pin 4 and the LED string 42; the second circuit part 26 comprises a first voltage comparator D2, a second thin film transistor Q2, a second resistor R2, a third resistor R3 and a second capacitor C2, the first voltage comparator D2 comprises a first positive input terminal, a first negative input terminal and a first output terminal, the first positive input terminal of the first voltage comparator D2 is electrically connected to the first voltage source 46, the first negative input terminal is electrically connected to the third pin 3 and one end of the second capacitor C2, the first output terminal is electrically connected to the second thin film transistor Q2, the second thin film transistor Q2 is electrically connected to the one end of the second resistor R2, the second thin film transistor Q2 is also connected to the ground, the other end of the second resistor R2 is electrically connected to the second pin 2, one end of the third resistor R3 is electrically connected to the other end of the second resistor R2, and the other end is connected to the ground, the other end of the second capacitor C2 is connected to the ground; the output voltage of the first voltage source 46 is lower than the predetermined voltage value of the second capacitor C2.

Specifically, the first thin film transistor Q1 comprises a first gate g1, a first source s1 and a first drain d1, the first gate g1 is electrically connected to the first pin 1, the first source s1 is electrically connected to the ground, the first drain d1 is respectively connected to the anode of the diode D1 and the other end of the first inductor L. When the voltage on the first gate g1 of the first thin film transistor Q1 is high voltage, the constant current driving chip 22 charges the second capacitor C2; when the voltage on the first gate g1 is low voltage, the constant current driving chip 22 stops charging the second capacitor C2. The second thin film Q2 comprises a second gate g2, a second source s2 and a second drain d2. The second gate g2 is electrically connected to the first output terminal of the first voltage comparator D2. The second source s2 is electrically connected to the ground. The second drain d2 is electrically connected to the other end of the second resistor R2. The first capacitor C1 is polarized capacitor, the positive electrode thereof is electrically connected to the negative electrode of the diode D1, the negative electrode thereof is connected to the ground.

The predetermined voltage of the second capacitor C2 could be the voltage of the second capacitor C2 which is fully charged, the value thereof can be determined by choosing the specification of the second capacitor C2.

Furthermore, the constant current driving chip 22 comprises: a control module 32, a second voltage comparator D3, a current source 36 and a second voltage source 34. The control module 32 comprises a fifth pin to a eighth pin 5, 6, 7, 8. The second voltage comparator D3 comprises a second positive input pin, a second negative input pin and a second output pin. The fifth pin 5 is respectively connected to the first pin 1 and the third pin 3. The sixth pin 6 is electrically connected to the second pin 2. The seventh pin 7 is electrically connected to the second output terminal of the second comparator D3. The eighth pin 8 is electrically connected to the fourth pin 4. The second positive input pin is respectively connected to the current source 36, the third pin 3, the fifth pin 5 and the first pin 1. The second negative input pin is electrically connected to the second voltage source 34.

Step 20, during boot time, the third pin 3 charging the second capacitor C2, thus the voltage of the third pin being lower, the voltage of the first positive input terminal of the first voltage comparator D2 being higher than the voltage of the first negative input terminal, the first voltage comparator D2 outputting high voltage.

Step 30, the second thin film transistor Q2 turning on, the first resistor R1 and the second resistor R2 being connected in parallel, the total resistance on the second pin being decreased, the frequency of the driving signal output transferred to the first thin film transistor Q1 by the constant current driving chip being decreased, the turning-on time per cycle of the first thin film transistor Q1 being decreased, at the same time, the frequency of the constant current driving chip charging to the second capacitor C2 being decreased, improving the charging speed.

When the second resistor R2 is turned on, the first resistor R1 and the second resistor R2 are connected in parallel, the total resistance (the driving signal frequency set resistance) on the second pin 2 is decreased, the control module 32 adjusts the frequency of the driving signal of the first thin film transistor Q1 according to the total resistance on the second pin 2, that is, increase the frequency of the driving signal. At this time, the turning-on time of the first thin film transistor Q1 in a unit period is decreased, the current flowing through the inductor L and the first thin film transistor Q1 is decreased, and the inrush current to the component is decreased. At the same time, the driving signal frequency of the first thin film transistor Q1 affects the charge frequency of the second capacitor C2 on the third pin 3 output by the internal current source of the constant current driving chip 22, the charge time of the constant current driving chip 22 charging the second capacitor C2 is decreased, which transmits the more energy. The voltage rising time of the second capacitor C2 on the third pin 3 is decreased, which reduces soft-start time.

Step 40, as the charge of the second capacitor C2, when the voltage of the first negative input terminal of the first voltage comparator D2 being higher than that of the first positive input terminal, which means the voltage of the second capacitor is raised to the predetermined voltage value, the first voltage comparator D2 outputting the low voltage.

Step 50, the second thin film transistor Q2 is turned off, disconnecting the second resistor R2, the driving frequency of the driving signal output to the first thin film transistor Q1 by the constant current driving chip 22 being decreased, returning to the normal state, the constant current driving chip 22 being into normal operation state.

When the frequency of the driving signal of the first thin film transistor Q1 output by the constant current driving chip 22 is decreased, it returns to the normal state, which means the frequency value of the driving signal of the first thin film transistor Q1 according to the prior art. The constant current driving chip 22 works in the normal operation. At this point, the soft-start is completed.

In summary, the backlight driving circuit and the method for reducing the soft-start time of the backlight driving circuit according to the present invention control the driving signal frequency of the constant current driving chip to set the resistance value by adding a voltage detection circuit on the soft-start pin, and further changes the frequency of the driving signal of the first thin film transistor. During the soft-start, it increases the charging speed of the second capacitor, reduces the boot soft-start time, decreases the current through the inductor and the first thin film transistor during the boot time, reduces the risk of inrush current during boot time, and extends the service life.

For those having ordinary skills in the art, the technical idea and the technical solution can be changed and modified according to the present invention. Any deduction or modification according to the present invention is considered encompassed in the scope of protection defined by the clams of the present invention.

What is claimed is:

1. A backlight driving circuit, comprising: a constant current driving chip, a first circuit part which is electrically connected to the constant current driving chip, and a second circuit part which is electrically connected to the constant current driving chip;

wherein, the constant current driving chip comprises a first pin, a second pin, a third pin and a fourth pin, the first circuit part is electrically connected to the constant current driving chip through the first pin and the fourth pin, the second circuit part is electrically connected to the constant current driving chip through the second pin and the third pin;

wherein, the first circuit part comprises an inductor (L), a first thin film transistor (Q1), a diode (D1), a first capacitor (C1) and a first resistor (R1), one end of the inductor (L) is used to electrically connect to a driving power, the other end is electrically connected to the first thin film transistor (Q1) and the anode of diode (D1), the first thin film transistor (Q1) is electrically connected to the first pin, the first thin film transistor (Q1) is further connected to the ground, the cathode of diode (D1) is electrically connected to a LED string, one end of the capacitor (C1) is electrically connected to the cathode of the diode (D1), and the other end is connected to the ground, one end of the first resistor (R1) is connected to the ground, and the other end is electrically connected to the fourth pin and the LED string;

wherein, the second circuit part comprises a first voltage comparator (D2), a second thin film transistor (Q2), a second resistor (R2), a third resistor (R3) and a second capacitor (C2), the first voltage comparator (D2) comprises a first positive input terminal, a first negative input terminal and a first output terminal, the first positive input terminal of the first voltage comparator (D2) is electrically connected to a first voltage source, the first negative input terminal is electrically connected to the third pin and one end of the second capacitor (C2), the first output terminal is electrically connected to the second thin film transistor (Q2), the second thin film transistor (Q2) is electrically connected to the one end of the second resistor (R2), the second thin film transistor (Q2) is also connected to the ground, the other end of the second resistor (R2) is electrically connected to the second pin, one end of the third resistor (R3) is electrically connected to the other end of the second resistor (R2), and the other end is connected to the ground, the other end of the second capacitor (C2) is connected to the ground; the output voltage of the first voltage source is lower than the predetermined voltage value of the second capacitor (C2).

2. The backlight driving circuit as claimed in claim 1, wherein, the first thin film transistor (Q1) comprises a first gate (g1), a first source (s1) and a first drain (d1), the first gate (g1) is electrically connected to the first pin, the first source (s1) is electrically connected to the ground, the first drain (d1) is respectively connected to the anode of the diode (D1) and the other end of the first inductor (L).

3. The backlight driving circuit as claimed in claim 1, wherein, the second thin film (Q2) comprises a second gate (g2), a second source (s2) and a second drain (d2), the second gate (g2) is electrically connected to the first output terminal of the first voltage comparator (D2), the second source (s2) is electrically connected to the ground, the second drain (d2) is electrically connected to the other end of the second resistor (R2).

4. The backlight driving circuit as claimed in claim 1, wherein, the constant current driving chip comprises: a control module, a second voltage comparator (D3), a current source and a second voltage source, the control module comprises a fifth to an eighth pin, the second voltage comparator (D3) comprises a second positive input pin, a second negative input pin and a second output pin, the fifth pin is respectively connected to the first pin and the third pin, the sixth pin is electrically connected to the second pin, the seventh pin is electrically connected to the second output terminal of the second comparator (D3), the eighth pin is electrically connected to the fourth pin, the second positive input pin is respectively connected to the current source, the third pin, the fifth pin and the first pin, the second negative input pin is electrically connected to the second voltage source.

5. A backlight driving circuit, comprising: a constant current driving chip, a first circuit part which is electrically connected to the constant current driving chip, and a second circuit part which is electrically connected to the constant current driving chip;

wherein, the constant current driving chip comprises a first pin, a second pin, a third pin and a fourth pin, the first circuit part is electrically connected to the constant current driving chip through the first pin and the fourth pin, the second circuit part is electrically connected to the constant current driving chip through the second pin and the third pin;

wherein, the first circuit part comprises an inductor (L), a first thin film transistor (Q1), a diode (D1), a first capacitor (C1) and a first resistor (R1), one end of the inductor (L) is used to electrically connect to a driving power, the other end is electrically connected to the first thin film transistor (Q1) and the anode of diode (D1), the first thin film transistor (Q1) is electrically connected to the first pin, the first thin film transistor (Q1) is further connected to the ground, the cathode of diode (D1) is electrically connected to a LED string, one end of the capacitor (C1) is electrically connected to the cathode of the diode (D1), and the other end is connected to the ground, one end of the first resistor (R1) is connected to the ground, and the other end is electrically connected to the fourth pin and the LED string;

wherein, the second circuit part comprises a first voltage comparator (D2), a second thin film transistor (Q2), a second resistor (R2), a third resistor (R3) and a second capacitor (C2), the first voltage comparator (D2) comprises a first positive input terminal, a first negative input terminal and a first output terminal, the first positive input terminal of the first voltage comparator (D2) is electrically connected to a first voltage source, the first negative input terminal is electrically connected to the third pin and one end of the second capacitor (C2), the first output terminal is electrically connected to the second thin film transistor (Q2), the second thin film transistor (Q2) is electrically connected to the one end of the second resistor (R2), the second thin film transistor (Q2) is also connected to the ground, the other end of the second resistor (R2) is electrically connected to the second pin, one end of the third resistor (R3) is electrically connected to the other end of the second resistor (R2), and the other end is connected to the ground, the other end of the second capacitor (C2) is connected to the ground; the output voltage of the first voltage source is lower than the predetermined voltage value of the second capacitor (C2);

wherein, the first thin film transistor (Q1) comprises a first gate (g1), a first source (s1) and a first drain (d1), the first gate (g1) is electrically connected to the first pin, the first source (s1) is electrically connected to the ground, the first drain (d1) is respectively connected to the anode of the diode (D1) and the other end of the first inductor (L);

wherein, the second thin film (Q2) comprises a second gate (g2), a second source (s2) and a second drain (d2), the second gate (g2) is electrically connected to the first output terminal of the first voltage comparator (D2), the second source (s2) is electrically connected to the ground, the second drain (d2) is electrically connected to the other end of the second resistor (R2).

6. The backlight driving circuit as claimed in claim 5, wherein, the constant current driving chip comprises: a control module, a second voltage comparator (D3), a current source and a second voltage source, the control module comprises a fifth to an eighth pin, the second voltage comparator (D3) comprises a second positive input pin, a second negative input pin and a second output pin, the fifth pin is respectively connected to the first pin and the third pin, the sixth pin is electrically connected to the second pin, the seventh pin is electrically connected to the second output terminal of the second comparator (D3), the eighth pin is electrically connected to the fourth pin, the second positive input pin is respectively connected to the current source, the third pin, the fifth pin and the first pin, the second negative input pin is electrically connected to the second voltage source.

7. A method for reducing soft-start time of the backlight driving circuit, comprising the following steps:

step (10), providing a backlight driving circuit, which comprises: a constant current driving chip, a first circuit part which is electrically connected to the constant current driving chip, and a second circuit part which is electrically connected to the constant current driving chip; wherein, the first circuit part comprises an inductor (L), a first thin film transistor (Q1), a diode (D1), a first capacitor (C1) and a first resistor (R1), one end of the inductor (L) is used to electrically connect to a driving power, the other end is electrically connected to the first thin film transistor (Q1) and the anode of diode (D1), the first thin film transistor (Q1) is electrically connected to a first pin, the first thin film transistor (Q1) is also connected to the ground, the cathode of diode (D1) is electrically connected to a LED string, one end of the capacitor (C1) is electrically connected to the cathode of the diode (D1), and the other end is connected to the ground, one end of the first resistor (R1) is connected to the ground, and the other end is electrically connected to a fourth pin and the LED string; wherein, the second circuit part comprises a first voltage comparator (D2), a second thin film transistor (Q2), a second resistor (R2), a third resistor (R3) and a second capacitor (C2), the first voltage comparator (D2) comprises a first positive input terminal, a first negative input terminal and a first output terminal, the first positive input terminal of the first voltage comparator (D2) is electrically connected to a first voltage source, the first negative input terminal is electrically connected to a third pin and one end of the second capacitor (C2), the first output terminal is electrically connected to the second thin film transistor (Q2), the second thin film transistor (Q2) is electrically connected to the one end of the second resistor (R2), the second thin film transistor (Q2) is further connected to the ground, the other end of the second resistor (R2) is electrically connected to a second pin, one end of the third resistor (R3) is electrically connected to the other end of the second resistor (R2), the other end is connected to the ground, and the other end of the second capacitor (C2) is connected to the ground; the output voltage of the first voltage source is lower than the predetermined voltage value of the second capacitor (C2);

step (20), during boot time, the third pin charging the second capacitor (C2), thus the voltage of the third pin being lower, the voltage of the first positive input terminal of the first voltage comparator (D2) being higher than the voltage of the first negative input terminal, the first voltage comparator (D2) outputting a high voltage to the second thin film transistor (Q2);

step (30), the second thin film transistor (Q2) turning on, the first resistor (R1) and the second resistor (R2) being connected in parallel, the total resistance on the second pin being decreased, the frequency of the driving signal output transferred to the first thin film transistor (Q1) by the constant current driving chip being decreased, the turning-on time per cycle of the first thin film transistor (Q1) being decreased, at the same time, the frequency of the constant current driving chip charging to the second capacitor (C2) being decreased, improving the charging speed;

step (40), as the charge of the second capacitor (C2), when the voltage of the first negative input terminal of the first voltage comparator (D2) being higher than that of the first positive input terminal, which means the voltage of the second capacitor is raised to the predetermined voltage value, the first voltage comparator (D2) outputting the low voltage;

step (50), the second thin film transistor (Q2) is turned off, disconnecting the second resistor (R2), the driving frequency of the driving signal output to the first thin film transistor (Q1) by the constant current driving chip being decreased, returning to the normal state, the constant current driving chip being into normal operation state.

8. The method for reducing soft-start time of the backlight driving circuit as claimed in claim 7, wherein, the first thin film transistor (Q1) comprises a first gate (g1), a first source (s1) and a first drain (d1), the first gate (g1) is electrically connected to the first pin, the first source (s1) is electrically connected to the ground, and the first drain (d1) is respectively connected to the anode of the diode (D1) and the other end of the first inductor (L).

9. The method for reducing soft-start time of the backlight driving circuit as claimed in claim 8, wherein, when the voltage on the first gate (g1) of the first thin film transistor (Q1) is high voltage, the constant current driving chip (22) charges the second capacitor (C2); when the voltage on the first gate (g1) is low voltage, the constant current driving chip stops charging the second capacitor (C2).

10. The method for reducing soft-start time of the backlight driving circuit as claimed in claim 7, wherein, the second thin film (Q2) comprises a second gate (g2), a second source (s2) and a second drain (d2), the second gate (g2) is electrically connected to the first output terminal of the first voltage comparator (D2), the second source (s2) is electrically connected to the ground, the second drain (d2) is electrically connected to the other end of the second resistor (R2).

11. The method for reducing soft-start time of the backlight driving circuit as claimed in claim 7, wherein, the constant current driving chip comprises: a control module, a second voltage comparator (D3), a current source and a second voltage source, the control module comprises a fifth to an eighth pin, the second voltage comparator (D3) comprises a second positive input pin, a second negative input pin and a second output pin, the fifth pin is respectively connected to the first pin and the third pin, the sixth pin is electrically connected to the second pin, the seventh pin is electrically connected to the second output terminal of the second comparator (D3), the eighth pin is electrically connected to the fourth pin, the second positive input pin is respectively connected to the current source, the third pin, the fifth pin and the first pin, the second negative input pin is electrically connected to the second voltage source.

* * * * *